US010851792B2

(12) United States Patent
Gebert

(10) Patent No.: US 10,851,792 B2
(45) Date of Patent: Dec. 1, 2020

(54) DIAGONAL FAN

(71) Applicant: ebm-papst Mulfingen GmbH & Co. KG, Mulfingen (DE)

(72) Inventor: Daniel Gebert, Öhringen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 50 days.

(21) Appl. No.: 16/086,482

(22) PCT Filed: Oct. 4, 2017

(86) PCT No.: PCT/EP2017/075261

§ 371 (c)(1),
(2) Date: Sep. 19, 2018

(87) PCT Pub. No.: WO2018/095633

PCT Pub. Date: May 31, 2018

(65) Prior Publication Data

US 2019/0101122 A1 Apr. 4, 2019

(30) Foreign Application Priority Data

Nov. 22, 2016 (DE) ..... 10 2016 122 533

(51) Int. Cl.
*F04D 17/16* (2006.01)
*F04D 25/06* (2006.01)
(Continued)

(52) U.S. Cl.
CPC ..... *F04D 17/165* (2013.01); *F04D 17/16* (2013.01); *F04D 25/064* (2013.01);
(Continued)

(58) Field of Classification Search
CPC .... F04D 17/165; F04D 23/005; F04D 29/183; F04D 25/064; F04D 25/0646; F05D 2210/44
See application file for complete search history.

(56) References Cited

U.S. PATENT DOCUMENTS 2,855,141 A * 10/1958 Rijn ..... F04D 25/0693 417/423.14
5,695,318 A 12/1997 Harmsen
(Continued)

FOREIGN PATENT DOCUMENTS

DE 41 27 134 A1 2/1993
DE 10 2004 058003 A1 3/2006
(Continued)

OTHER PUBLICATIONS

Search Report for German Application No. DE 10 2016 122 533.9, dated Sep. 1, 2017, 6 pgs.
(Continued)

*Primary Examiner* — Ifor Kershteyn
*Assistant Examiner* — Juan G Flores
(74) *Attorney, Agent, or Firm* — Dickinson Wright PLLC

(57) ABSTRACT

Diagonal fan having a fan housing, within which an external-rotor motor and an impeller are accommodated, wherein the external-rotor motor has a stator and a rotor which at least partly surrounds the stator, and an axial flow duct runs between the fan housing and the external-rotor motor as far as a discharge opening, surrounding the external-rotor motor, of the diagonal fan, through which duct, during operation, air which is drawn in by means of the impeller can be conveyed to the discharge opening, and wherein the impeller is integrated in the rotor.

13 Claims, 2 Drawing Sheets

(51) Int. Cl.
*F04D 29/44* (2006.01)
*F04D 29/66* (2006.01)
*F04D 29/42* (2006.01)

(52) U.S. Cl.
CPC ..... *F04D 25/0646* (2013.01); *F04D 29/4253* (2013.01); *F04D 29/444* (2013.01); *F04D 29/666* (2013.01); *F05B 2240/12* (2013.01); *F05B 2240/14* (2013.01); *F05B 2260/96* (2013.01)

(56) References Cited

U.S. PATENT DOCUMENTS 7,048,499 B2 * 5/2006 Mathson ..... F04D 17/06 415/119
2006/0045736 A1 3/2006 Lee et al.
2006/0267422 A1 11/2006 Franz et al.
2009/0246017 A1 10/2009 Lee et al.
2013/0236303 A1 9/2013 Teramoto et al.
2014/0023510 A1 * 1/2014 Ruck ..... F01D 5/14 416/223 R
2015/0369247 A1 12/2015 Schöne et al.
2016/0201466 A1 * 7/2016 Fink ..... F01D 11/001 416/185
2018/0142700 A1 5/2018 Hub et al.

FOREIGN PATENT DOCUMENTS

DE 10 2014 210 373 A1 12/2015
DE 10 2015 207 800 A1 11/2016

OTHER PUBLICATIONS

International Search Report with Written Opinion dated Dec. 20, 2017, 8 pgs.

* cited by examiner

DIAGONAL FAN

RELATED APPLICATIONS

This application claims priority to German Patent Application No. 10 2016 122 533.9, filed on Nov. 22, 2016 and PCT/EP2017/075261, filed Oct. 4, 2017.

FIELD

The present disclosure relates to a diagonal fan in improved compact design with high power density and low noise output.

BACKGROUND

Diagonal fans and their uses are generally known from the prior art, for example from DE 10 2014 210 373 A1.

Diagonal fans are employed in applications with high demands on the air output along with rather high backpressure and low space requirement, such as in refrigeration equipment or range hoods. Due to the large motor diameter of the axial central motor of diagonal fans as compared to the installation space, the discharge area at the discharge opening is relatively small, resulting in large flow exit losses due to high dynamic pressure at the exit of the diagonal fan.

It is always the goal to increase the performance of the fan, while the noise output remains unchanged or even decreases. Furthermore, the fans need to have an increasingly more compact design, in order to reduce the space requirement.

BRIEF SUMMARY

Therefore, the present disclosure provides a diagonal fan in compact design with high power density and good noise behavior.

The present disclosure overcomes problems from large flow exit losses by the combination of features according to patent claim 1.

According to the present disclosure, a diagonal fan with a fan housing is proposed, within which an external-rotor motor and an impeller are accommodated, wherein the external-rotor motor has a stator and a rotor which at least partly surrounds the stator. An axial flow duct runs between the fan housing and the external-rotor motor as far as a discharge opening, surrounding the external-rotor motor, of the diagonal fan, through which flow duct, during operation, air which is drawn in by means of the impeller can be conveyed to the discharge opening. The impeller is integrated in the rotor.

The integration of the impeller in the rotor is provided in one embodiment in that the rotor and impeller are designed as a single piece. Hence, the number of parts and the axial installation space are minimized. Alternatively to the single-piece design, the integral design may also be accomplished in that parts of the impeller, such as the impeller vanes, are fastened on the rotor.

The diagonal fan in one modification comprises an air guide apparatus with several air guide vanes distributed in the circumferential direction in a discharge portion bordering on the discharge opening. The air guide vanes extend in the axial direction at least in an overlap portion beyond the rotor and are spaced apart from it with a radial air gap. Thus, the rotor rotates relative to the air guide vanes.

In one advantageous embodiment for the noise output and performance of the diagonal fan the air gap has a size which corresponds at most to 5%, especially at most to 1.5% of a maximum radial installation space of the diagonal fan. The maximum radial installation space is determined by the outermost casing contour of the overall diagonal fan. In one imaginary embodiment of cylindrical shape, the maximum radial installation space would correspond to the maximum outer diameter.

Likewise advantageous to the solution of the problem is an embodiment of the diagonal fan in which a ratio of the axial length of the overlap portion (Ly) of the air guide vanes to a non-overlapping portion in which the air guide vanes do not overlap the rotor in the axial direction lies in a range of 0.5 to 4.0, preferably in a range of 1.5 to 2.5. The air gap extends in the axial direction beyond the overlap region, preferably of constant size.

Moreover, it is provided in one embodiment that the air guide vanes are fastened for a portion to the fan housing in the axial direction. In particular, the air guide vanes may be fastened to the fan housing in an axially inward directed region bordering on the discharge opening.

In one modification of the diagonal fan favorable to the solution of the problem, the impeller and/or the air guide vanes are geometrically configured such that an axial spacing between the air guide vanes and the impeller increases in the radial direction from a first spacing to a second spacing situated further radially outward. For example, the configuration may be accomplished by slanting axial outer edges pointing toward each other, by which the spacing can be varied. In one advantageous solution, the air guide vanes have a straight axial edge, while the impeller vanes are beveled radially outward in the direction of the inlet opening, so that the spacing between the air guide vanes increases in the discharge region and the impeller vanes, looking radially outward. Moreover, it is advantageous for a radius of the impeller at a point of attack of the first spacing to be larger than the first axial spacing. The point of attack is the point at which the first spacing is measured. The first spacing can be set variably, and the corresponding radius is obtained accordingly from this. The same holds accordingly for the second spacing and the second radius.

One advantageous embodiment of the diagonal fan proposes that the fan housing is multiple-piece and comprises an inlet nozzle and a discharge piece, while the inlet nozzle has an intake opening and the discharge piece comprises the discharge opening.

In one compact embodiment, moreover, a two-piece embodiment is favorable, in which the inlet nozzle is connected to the discharge piece bordering directly on it in the axial direction. In one compact design, the inlet nozzle and the discharge piece are inserted into each other.

Likewise favorable to a compact, axially short design is an embodiment of the diagonal fan whereby the inlet nozzle comprises an inlet portion forming the inlet opening and reducing the flow diameter, which extends in the axial direction into the impeller.

A variant embodiment advantageous for low noise output is one in which the impeller comprises a cover disk, while the impeller vanes extend from the rotor to the cover disk. The cover disk may completely overlap the impeller vanes at their outer axial edges in the radial direction. Furthermore, the cover disk may have an axially parallel portion pointing toward the inlet opening, into which the inlet nozzle extends.

The issue of the small discharge area may be improved in that the discharge opening forms a discharge area which does not have rotational symmetry. This is made possible, for example, by a square shape of the discharge area in cross section.

The noise output is likewise influenced favorably in the diagonal fan when the intake opening has an intake diameter corresponding to 40 to 75%, preferably 50 to 60% of a maximum radial installation space of the diagonal fan. The size of the intake opening is reduced as compared to axial fans, in order to improve the inflow stream.

The diagonal fan in one embodiment is characterized in that the impeller has an impeller diameter which corresponds to 80 to 95% of a maximum radial installation space of the diagonal fan.

An embodiment is also advantageous in which the impeller is situated bordering directly on the flow duct and an air flow generated by the impeller is delivered directly into the flow duct.

Other advantageous modifications of the present disclosure are characterized in the dependent claims or will be represented more closely below together with the description of the preferred embodiment of the present disclosure with the aid of the figures. There are shown:

DETAILED DESCRIPTION

Figure 1:
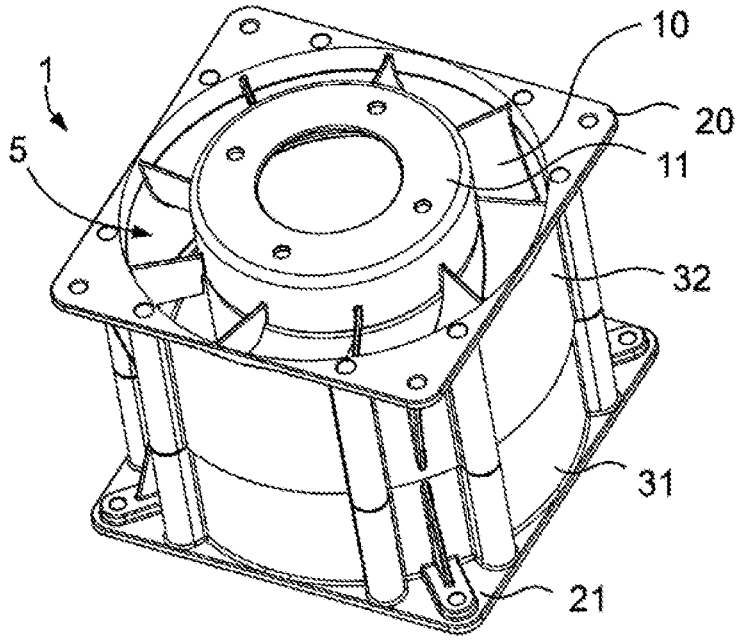
FIG. 1, a perspective view of a diagonal fan.
Figure 2:
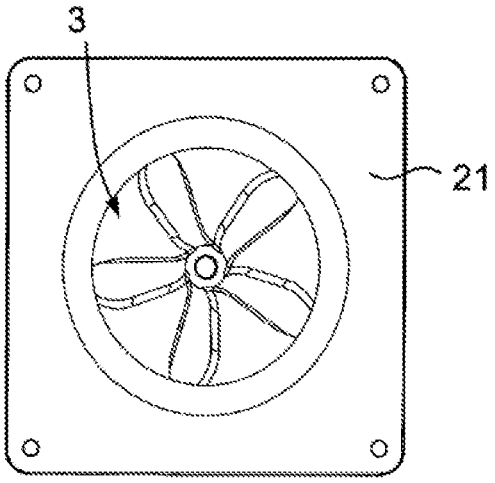
FIG. 2, a front view of the intake side of the diagonal fan of FIG. 1.
Figure 3:
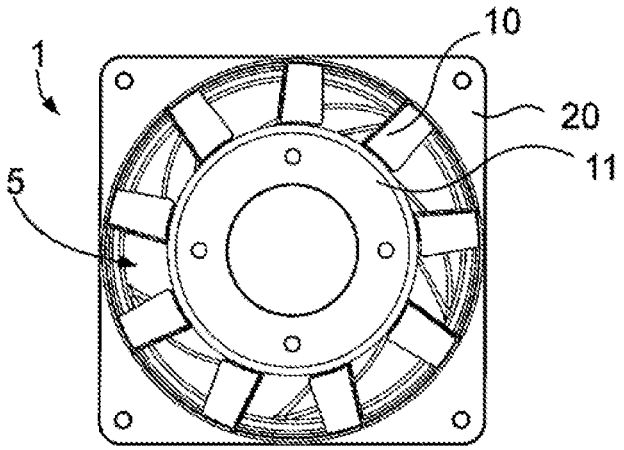
FIG. 3, a rear view of the intake side of the diagonal fan of FIG. 1.
Figure 4:
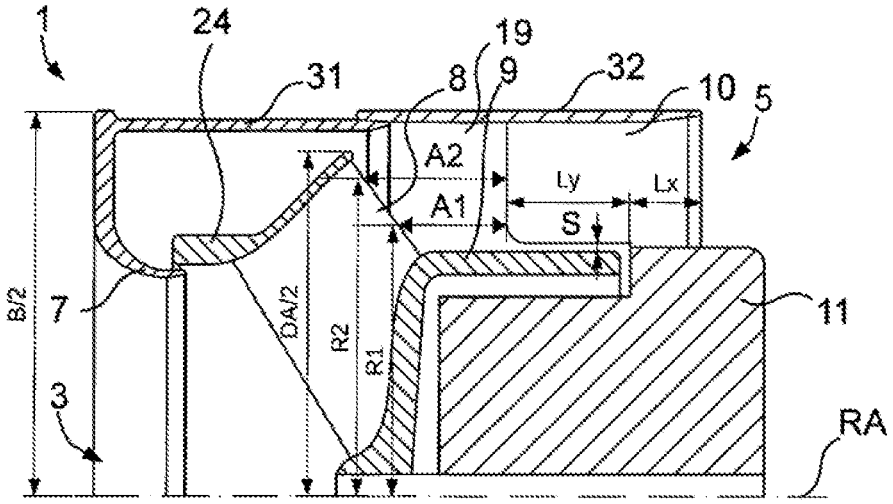
FIG. 4, a cross sectional view of the top half of the diagonal fan of FIG. 1.

FIGS. 1 to 3 show a sample embodiment of a diagonal fan 1 various views. FIG. 4 is a corresponding longitudinal section view for a more accurate representation of the individual components and their mutual arrangement.

The diagonal fan 1 comprises a two-piece fan housing formed from the inlet nozzle 31, having the inlet opening 3, and the discharge piece 32, having the discharge opening 5, at whose axial ends are formed a respective flange 21, 20. The inlet nozzle 31 is inserted into the discharge piece 32. Centered about the axis of rotation RA is provided the external-rotor motor with the stator 11 and the rotor 9, which covers the stator 11 for a portion in the axial direction.

The impeller of the diagonal fan 1 is formed from the rotor 9, the impeller vanes 8 arranged on it, and a cover disk 24 fully overlapping the impeller vanes in the radial direction, having an end portion running axially straight in the direction of the inlet opening 3. The rotor 9 forms a bottom disk for the impeller. The impeller is thus integrated in the rotor 9. The inlet nozzle 31 comprises an inlet portion 7 reducing the flow diameter, which extends in the axial direction into the impeller, so that the axially parallel end portion of the cover disk 24 and the inlet portion 7 overlap.

Axially bordering on the impeller, the axial flow duct 19 extends between the discharge piece 32 of the fan housing and the rotor 9 of the external-rotor motor as far as the discharge opening 5 surrounding the stator 11.

In a discharge portion bordering on the discharge opening 5 there is situated an air guide apparatus with several air guide vanes 10 distributed in the circumferential direction, which are also clearly seen in FIG. 3. Bordering on the discharge opening 5, the air guide vanes 10 are connected to the stator 11 and to the discharge piece 32. The air guide vanes 10 extend both in the axial direction and also in the circumferential direction. They extend in the axial direction beyond the rotor 9 in the overlap portion Ly and are spaced apart from the latter by a radial air gap S, where the air gap S in the embodiment depicted corresponds to 1% of the maximum radial installation space B of the diagonal fan 1. The size of the air gap S is constant over its axial extension. The ratio of the axial length of the overlap portion Ly of the air guide vanes 10 to the axially bordering non-overlapping portion Lx lies at a value of 2.1 in the embodiment depicted.

Referring in particular to FIG. 4, the spacing between the mutually facing axial edges of the air guide vanes 10 and the impeller vanes 8 increases in a direction, looking radially outward, from a first spacing A1 to a second spacing A2, where the axial edges of the air guide vanes 10 extend straight radially outward, while the impeller vanes 8 are slanted. The position of the first and second spacing can be chosen freely, while the radius R1 of the impeller at the point of attack of the first spacing A1 is larger than the first spacing A1. Moreover, the radius R2 of the impeller at the point of attack of the second spacing A2 is greater than the second spacing A2. The impeller has an impeller diameter corresponding to 90% of the maximum radial installation space B of the diagonal fan 1.

The invention claimed is:

1. A diagonal fan having a fan housing, within which an external-rotor motor and an impeller are accommodated, wherein the external-rotor motor has a stator and a rotor which at least partly surrounds the stator, and an axial flow duct runs between the fan housing and the external-rotor motor as far as a discharge opening, surrounding the external-rotor motor, of the diagonal fan, through which axial flow duct, during operation, air which is drawn in by means of the impeller and is conveyed to the discharge opening, and wherein the impeller is integrated in the rotor, and the impeller and the rotor are designed as a single piece, while an air guide apparatus with several air guide vanes distributed in the circumferential direction is arranged in a discharge portion bordering on the discharge opening, and the air guide vanes extend in the axial direction at least in an overlap portion (Ly) beyond the rotor and are spaced apart from the rotor with a radial air gap, wherein the fan housing is multiple-piece and comprises an inlet nozzle and a discharge piece, while the inlet nozzle has an intake opening and the discharge piece comprises the discharge opening, and wherein the inlet nozzle comprises an inlet portion reducing the flow diameter, which extends in the axial direction into the impeller, and wherein the impeller and/or the air guide vanes are designed such that an axial spacing between the air guide vanes and the impeller increases in the radial direction from a first spacing (A1) to a second spacing (A2), and wherein a radius (R1) of the impeller at a point of attack of the first spacing (A1) is larger than the first spacing (A1), and wherein the impeller comprises impeller vanes and a cover disk, while the impeller vanes extend from the rotor to the cover disk.

2. The diagonal fan as claimed in claim 1, wherein a ratio of the axial length of the overlap portion (Ly) of the air guide vanes to a non-overlapping portion (Lx) in which the air guide vanes do not overlap the rotor in the axial direction lies in a range of 0.5 to 4.0.

3. The diagonal fan as claimed in claim 1 wherein the air guide vanes are fastened for a portion to the fan housing in the axial direction.

4. The diagonal fan as claimed in claim 1, wherein the radial air gap corresponds at most to 5% of a maximum radial installation space of the diagonal fan.

5. The diagonal fan as claimed in claim 1, wherein the inlet nozzle is connected to the discharge piece bordering directly on the discharge piece in the axial direction.

6. The diagonal fan as claimed in claim 5, wherein the cover disk completely overlaps the impeller vanes in the radial direction.

7. The diagonal fan as claimed in claim 1, wherein the discharge opening forms a discharge surface which does not have rotational symmetry.

8. The diagonal fan as claimed in claim 1, wherein the intake opening has an intake diameter corresponding to 40 to 75% of a maximum radial installation space of the diagonal fan.

9. The diagonal fan as claimed in claim 1, wherein the impeller has an impeller diameter which corresponds to 80 to 95% of a maximum radial installation space of the diagonal fan.

10. The diagonal fan as claimed in claim 1, wherein the impeller is situated bordering directly on the axial flow duct and an air flow generated by the impeller is delivered directly into the axial flow duct.

11. The diagonal fan as claimed in claim 1, wherein a ratio of the axial length of the overlap portion (Ly) of the air guide vanes to a non-overlapping portion in which the air guide vanes do not overlap the rotor in the axial direction lies in a range of 1.5 to 2.5.

12. The diagonal fan as claimed in claim 1, wherein the radial air gap corresponds at most to 1.5% of a maximum radial installation space of the diagonal fan.

13. The diagonal fan as claimed in claim 1, wherein the intake opening has an intake diameter corresponding to 50 to 60% of a maximum radial installation space of the diagonal fan.

* * * * *